US007805802B2

(12) United States Patent
Shinler et al.

(10) Patent No.: US 7,805,802 B2
(45) Date of Patent: Oct. 5, 2010

(54) FLOOR CLEANING MACHINE DEBRIS COLLECTION SYSTEM

(75) Inventors: Kevin L. Shinler, North Branch, MN (US); Peter A. Loring, Saint Paul, MN (US); Laurence A. Jensen, Oakdale, MN (US)

(73) Assignee: Tennant Company, Minneapolis, MN (US)

( * ) Notice: Subject to any disclaimer, the term of this patent is extended or adjusted under 35 U.S.C. 154(b) by 969 days.

(21) Appl. No.: 11/584,677

(22) Filed: Oct. 20, 2006

(65) Prior Publication Data

US 2007/0089260 A1 Apr. 26, 2007

Related U.S. Application Data

(60) Provisional application No. 60/729,129, filed on Oct. 21, 2005.

(51) Int. Cl.
*A47L 5/00* (2006.01)
*E01H 1/08* (2006.01)

(52) U.S. Cl. ..... 15/319; 15/320; 15/340.1

(58) Field of Classification Search ..... 15/319, 15/320, 340.1–340.4; *A47L 5/00; E01H 1/08*
See application file for complete search history.

(56) References Cited

U.S. PATENT DOCUMENTS 5,901,407 A 5/1999 Boomgaarden ..... 15/320

*Primary Examiner*—David A. Redding
(74) *Attorney, Agent, or Firm*—Westman, Champlin & Kelly, P.A.

(57) ABSTRACT

A debris collection system for a floor cleaning machine includes a motorized cleaning head attached to a frame of the floor cleaning machine, a carriage attached to the frame, a debris tray, and a de-watering system. The debris tray is removably receivable within the carriage and is positioned to receive debris thrown from the motorized cleaning head. The de-watering system includes a liquid extracting component, a tray tubing section, a main tubing section, a waste recovery tank supported on the frame and a vacuum in vacuum communication with the main tubing section. The liquid extracting component is attached to the debris tray and is configured to extract liquid from within the debris tray. The tray tubing section has a first end that is coupled to the liquid extracting component and a second end that is mounted in fixed relation to the debris tray. The a main tubing section has a first end that is connected to the waste collection tank and a second end that is positioned to automatically couple to the second end of the tray tubing section upon installation of the debris tray.

20 Claims, 10 Drawing Sheets

FLOOR CLEANING MACHINE DEBRIS COLLECTION SYSTEM

CROSS-REFERENCE TO RELATED APPLICATION

The present application is based on and claims the benefit of U.S. provisional patent application Ser. No. 60/729,129, filed Oct. 21, 2005, the content of which is hereby incorporated by reference in its entirety.

FIELD OF THE INVENTION

The present invention generally relates to floor cleaning machines and, more particularly, to a debris collection system of a floor cleaning machine.

BACKGROUND

Floor cleaning in public, commercial, institutional and industrial buildings have led to the development of various specialized floor cleaning machines. These machines include dedicated floor sweeping machines, dedicated floor scrubbing machines and combination floor sweeping and scrubbing machines.

FIG. 1 shows an exemplary floor cleaner 300 in the form of a combination floor sweeping and scrubbing machine that is described in U.S. Pat. No. 5,901,407, which assigned to Tennant Company of Minneapolis, Minn. The floor cleaner 300 is a ride-on cleaner that includes a driver's seat 302 and controls 304. The floor cleaner 300 includes a sweep/scrub head 306 for performing sweeping and scrubbing operations on the floor. The depicted scrub head 306 includes two cylindrical brushes 308 that counter-rotate relative to each. Water or cleaning liquid is applied to the floor to a leading side 310 of the head 306 so the brushes 308 can scour the floor at the same time they are sweeping debris from the floor. A vacuum squeegee 312, positioned on a trailing side 314 of the head 306, collects soiled cleaning liquid, which is delivered it to a waste recovery tank 316 through tubing 318 under suction generated by a vacuum 320.

A debris tray 322 of the cleaner 300 is positioned on the trailing side 314 of the head 306 and the tray 322 collects wet and dry waste that is discharged from the head 306. Liquid can be removed from the tray 322 through a vacuumized de-watering system. The de-watering system includes a perforated separator 324 in the tray 306 that is connected to the waste recovery tank 316 through tubing 326. During cleaning operations, liquid in the tray 322 is extracted through the perforated separator 324 and the tubing 326 and is deposited into the waste recovery tank 316 in response to the suction generated by the vacuum fan 320.

The tray 322 must be manually dumped by the operator. The tray 322 is accessed by pivoting an end of the vacuum squeegee 312 away from the rear end 328 of the cleaner 300 and then pivoting a carriage 330, in which the tray 322 is supported, toward the rear end 328 and out from behind the wheel 332. One or more operators must directly handle the tray 322 to dump its contents. For example, the operator must grab the tray 322 directly by hand to remove the tray 322 from the carriage 330, move the tray 322 to the desired dumping location, dump the tray 322, and reinstall the tray 322 in the carriage 330. Since the tray 322 lacks wheels, it must either be carried or dragged to the desired dumping location.

As a result, one or more individuals are forced to interact/touch the collected waste material or waste material that has adhered to the tray 322. Additionally, the individuals must bend over to move and dump the tray 322, which can weigh as much as 150 pounds depending on the amount of waste collected and the amount of liquid present in the waste. The maneuvering of the tray 322 is further hampered by the necessity to drag it across the ground or carry it.

The tubing 326 connecting the perforated separator 324 to the waste recovery tank 316 includes a main tubing section 334 having an end coupled to the waste recovery tank 316 and a tray tubing section 336 having an end coupled to the perforated separator 324. The other ends of the main and tray tubing sections 334 and 336 must be manually coupled and decoupled during installation and removal of the tray 322 from the carriage 330 of the cleaner 300. Such a procedure requires the operator to get on the floor and reach underneath the cleaner 300 to locate and couple the two tubing sections together. Occasionally, this step in the process of reinstalling the tray 322 in the carriage 330 is overlooked thereby leaving the main and tray tubing sections 334 and 336 disconnected. When this occurs, the de-watering system becomes inactive and liquid can overflow the tray and contaminate the surface being cleaned. The tubing of the de-watering system must also have enough slack to allow the operator to make the necessary connection, which can also cause problems.

There exists a continuous demand for improvements to combination floor cleaning machines including, for example, simplifying waste removal operations, improving maintenance access to components of the machine, providing features that prevent or reduce the likelihood of damaging the machine, and other improvements.

SUMMARY

One embodiment of the invention relates to a debris collection system for a floor cleaning machine that includes a motorized cleaning head attached to a frame of the floor cleaning machine, a carriage attached to the frame, a debris tray, and a de-watering system. The debris tray is removably receivable within the carriage and is positioned to receive debris thrown from the motorized cleaning head. The de-watering system includes a liquid extracting component, a tray tubing section, a main tubing section, a waste recovery tank supported on the frame and a vacuum in vacuum communication with the main tubing section. The liquid extracting component is attached to the debris tray and is configured to extract liquid from within the debris tray. The tray tubing section has a first end that is coupled to the liquid extracting component and a second end that is mounted in fixed relation to the debris tray. The main tubing section has a first end that is connected to the waste collection tank and a second end that is positioned to automatically couple to the second end of the tray tubing section upon installation of the debris tray.

Additional embodiments of the invention relate to a floor cleaning machine that includes the debris collection system described above, and a method of coupling the second end of the tray tubing section to the second end of the main tubing section during installation of the debris tray into the carriage.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Embodiments of the present invention relate to a debris collection system of a hard floor cleaner. Although embodiments of the invention will be described below with respect to a combination floor sweeping and scrubbing machine, it will be apparent that embodiments of the invention are also useful with other hard floor cleaners, such as dedicated floor sweeping machines and dedicated floor scrubbing machines. Accordingly, embodiments of the debris collection system of the present invention include using the debris collection system with other types floor cleaning machines.

Figure 1:
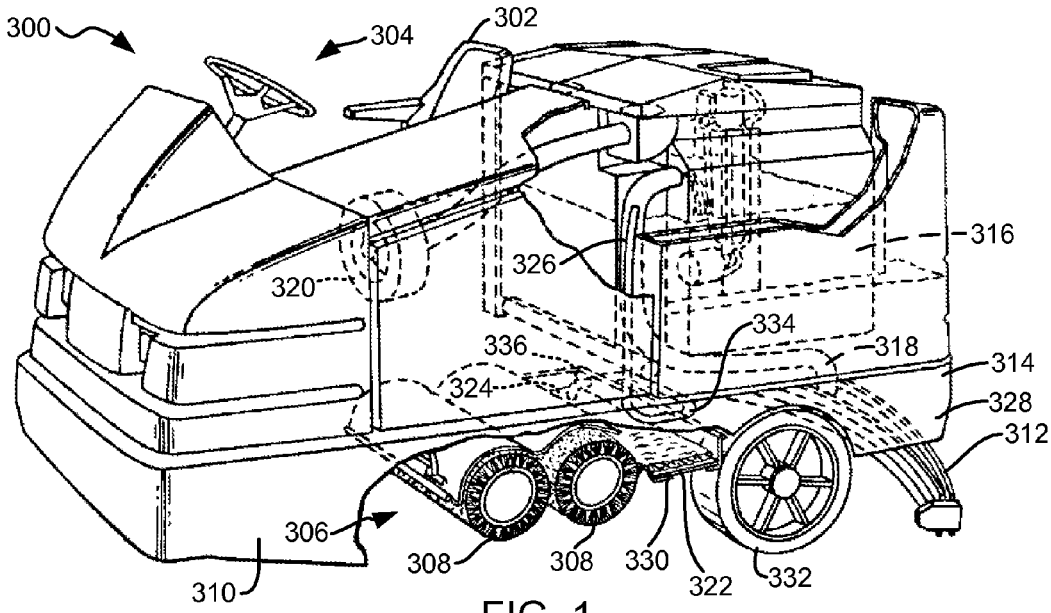
FIG. 1 (PRIOR ART)
FIG. 1 is a perspective view of an exemplary sweeping and scrubbing floor cleaning machine in accordance with the prior art.
Figure 2:
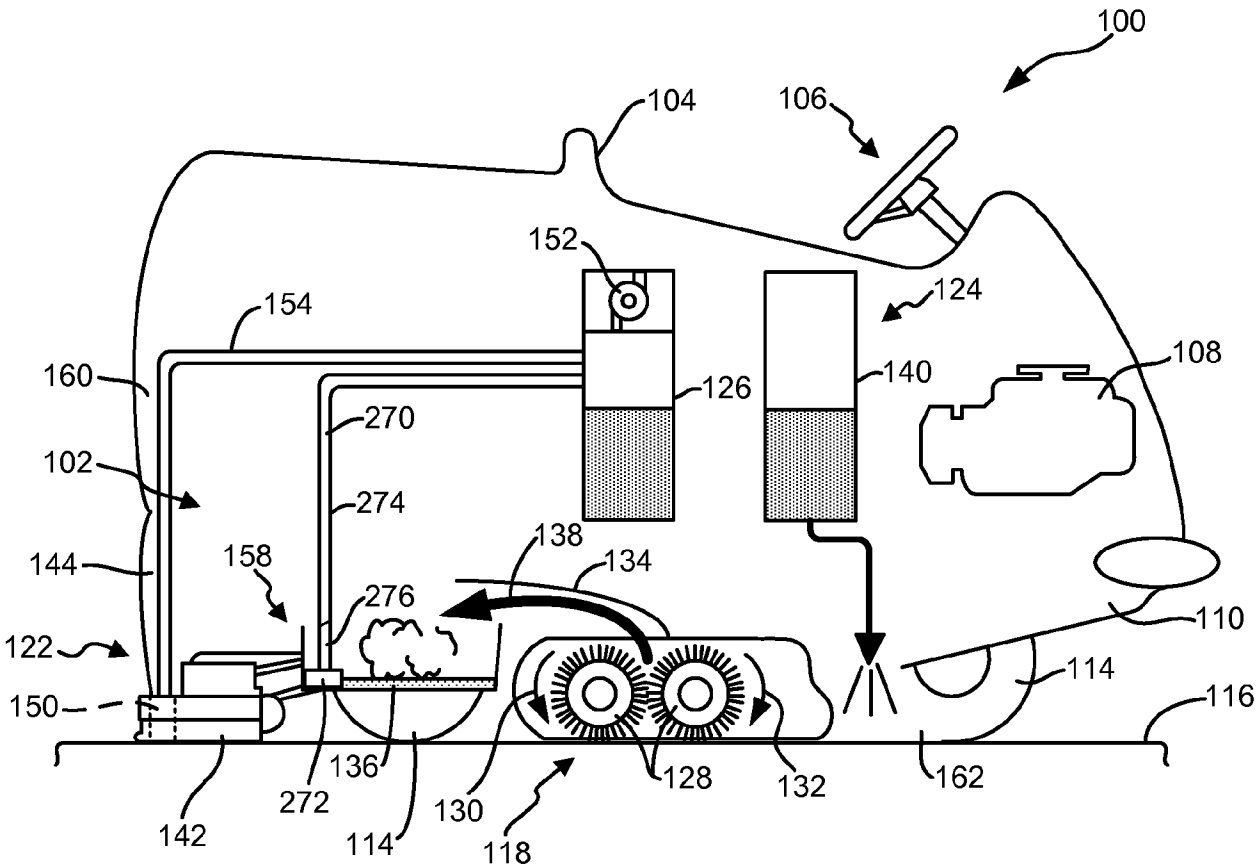
FIG. 2 is a simplified diagram of a sweeping and scrubbing floor cleaning machine in accordance with embodiments of the invention.
Figure 3:
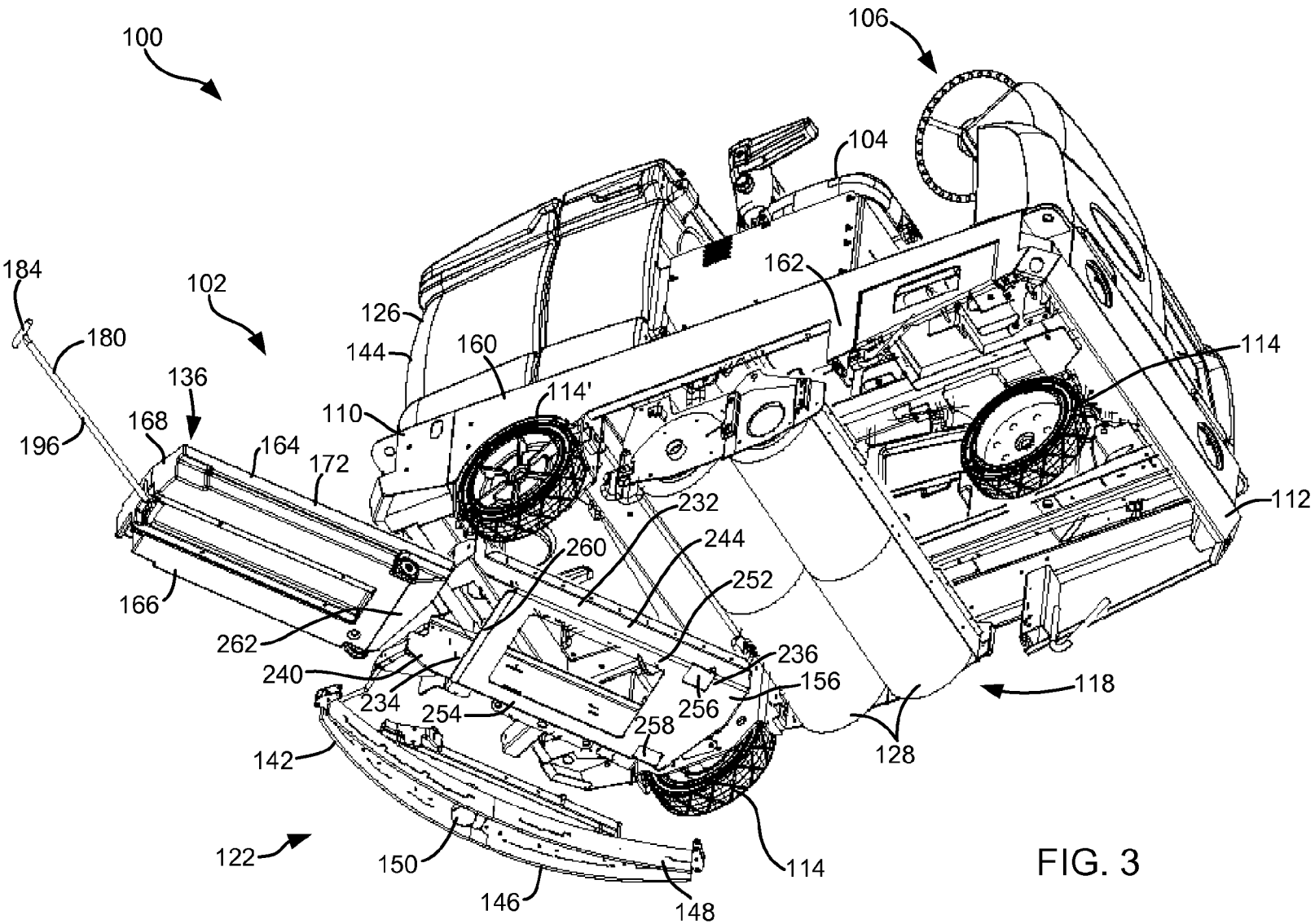
FIG. 3 is a bottom perspective and partially exploded view of a floor cleaning machine that includes a debris collection system in accordance with embodiments of the invention.

FIG. 2 is a simplified diagram of a sweeping and scrubbing floor cleaning machine 100 that includes a debris collection system 102 in accordance with embodiments of the invention. FIG. 3 is a bottom perspective and partially exploded view of a sweeping and scrubbing floor cleaning machine 100 that includes the debris collection system 102 in accordance with embodiments of the invention. In one embodiment, the machine 100 is a ride-on machine that includes a seat 104 and controls 106 for an operator. Alternatively, the machine 100 may be designed for use by an operator that walks behind the machine, or the machine may be configured to be towed behind a vehicle. The machine 100 may be powered through an on-board power source, such as batteries or an internal combustion engine 108 (FIG. 2), or powered through an electrical cord.

Embodiments of the machine 100 include components that are supported on a motorized mobile body 110. The mobile body 110 comprises a frame 112 supported on wheels 114 for travel over a surface 116, on which a cleaning operation is to be performed. The components that are supported on the mobile body 110 include, for example, a motorized cleaning head 118 and components of the debris collection system 102. Embodiments of the machine 100 can also include a fluid recovery system 122, a cleaning liquid or water dispensing system 124, a waste recovery tank 126, and other components.

The cleaning head 118 can include one or more brushes 128 that are configured for sweeping and/or scrubbing operations on the surface 116. In accordance with one embodiment of the invention, the cleaning head 118 is configured as a sweep/scrub head that is adapted to perform wet and/or dry sweeping operations, and scrubbing operations on the surface 116.

One embodiment of the cleaning head 118, shown in FIGS. 2 and 3 includes scrub/sweep brushes 128 that rotate in opposite directions, as indicated by arrows 130 and 132. One or more motors drive the rotation of the brushes 128. A deflector 134 over the surfaces of the brushes 128 directs or throws waste swept by the brushes 128 into a debris tray 136 of the debris collection system 102, as indicated by arrow 138.

During a dry sweeping operation, waste material 138 is swept by brushes 128 into the debris tray 136. During wet scrubbing and sweeping operations, water or a cleaning liquid contained in a tank 140 is sprayed to the surface 116 in front of the cleaning head 118. The wetted debris on the surface 116 is swept into the debris tray 136 by the brushes 128 while they also scrub the surface 116. The soiled cleaning liquid that is not swept into the tray 136 is then collected by the fluid recovery system 122 and deposited in the waste recovery tank 126.

One embodiment of the fluid recovery system 122 of the machine 100 includes a vacuum squeegee 142 mounted adjacent the rear end 144 of the machine 100, as shown in FIGS. 2 and 3. The vacuum squeegee 142 generally comprises a squeegee 146 that extends across the width of the machine 100 and a frame 148 that supports the squeegee 146. The vacuum squeegee 142 also includes a vacuum port 150 that is placed in vacuum communication with the vacuum fan 152 through tubing 154, as shown in FIG. 2. The vacuum fan 152 operates to remove liquid and particle waste collected by the vacuum squeegee 142 for deposit in the waste recovery tank 126.

Embodiments of the debris collection system 102 of the present invention include the motorized scrub head 118, a carriage 156 (FIG. 3) attached to the frame 112 of the mobile body 110, the debris tray 136, which is removably receivable within the carriage 156, and a de-watering system 158.

As mentioned above, the tray 136 is positioned to receive debris removed from the surface 116 and thrown by the motorized cleaning head 118. In one embodiment, the carriage 156 and the debris tray 136 are located on a trailing side 160 of the cleaning head 118, as shown in FIGS. 2 and 3. However, it is understood that the carriage 156 and the debris tray 136 can also be located to a leading side 162 of the motorized cleaning head 118 through appropriate adjustments, such as, an adjustment to the deflector 134 of the motorized cleaning head 118, for example.

Figure 4:
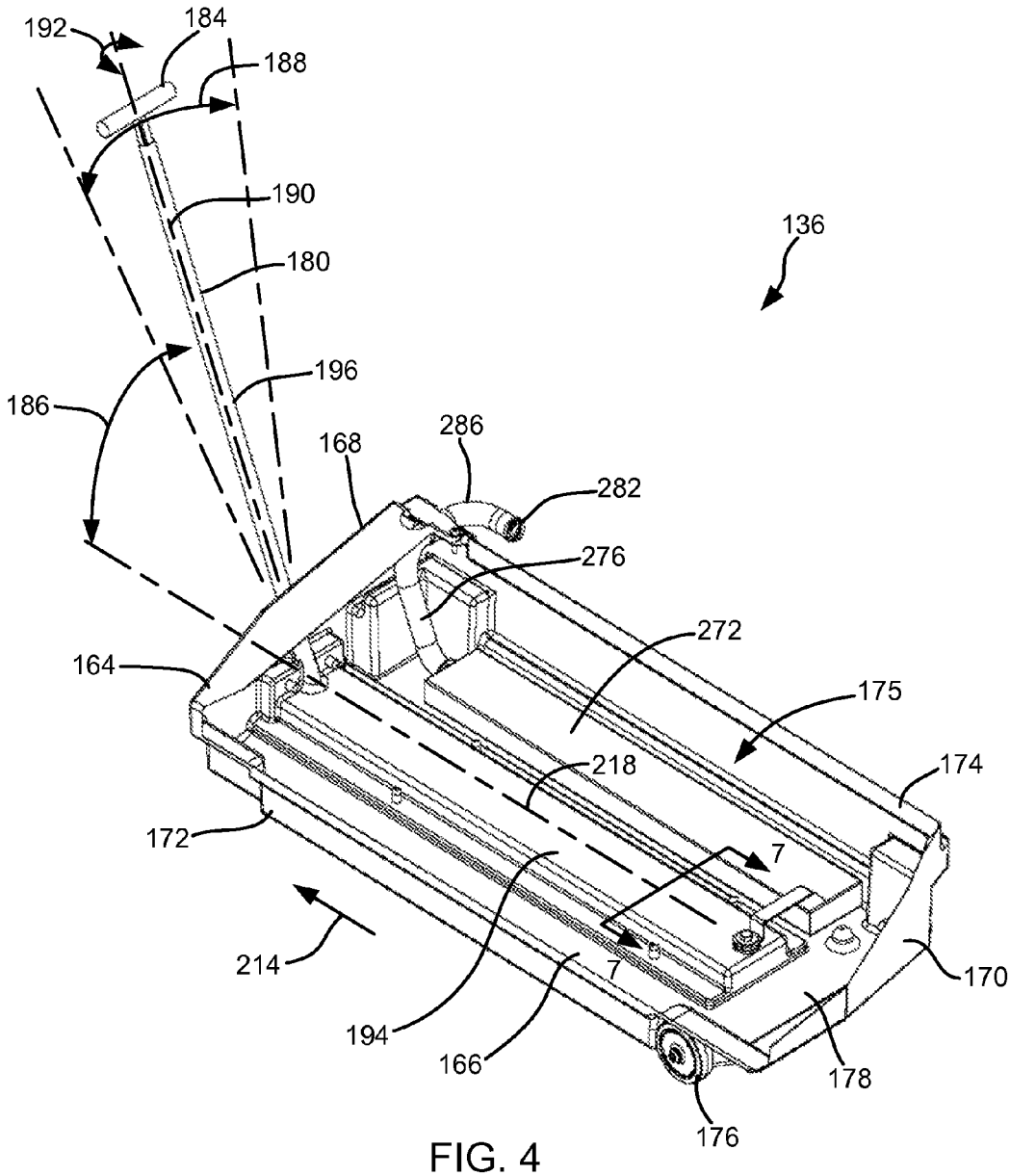
FIGS. 4-5 respectively are a perspective top and bottom views of a debris tray in accordance with embodiments of the invention.
Figure 5:
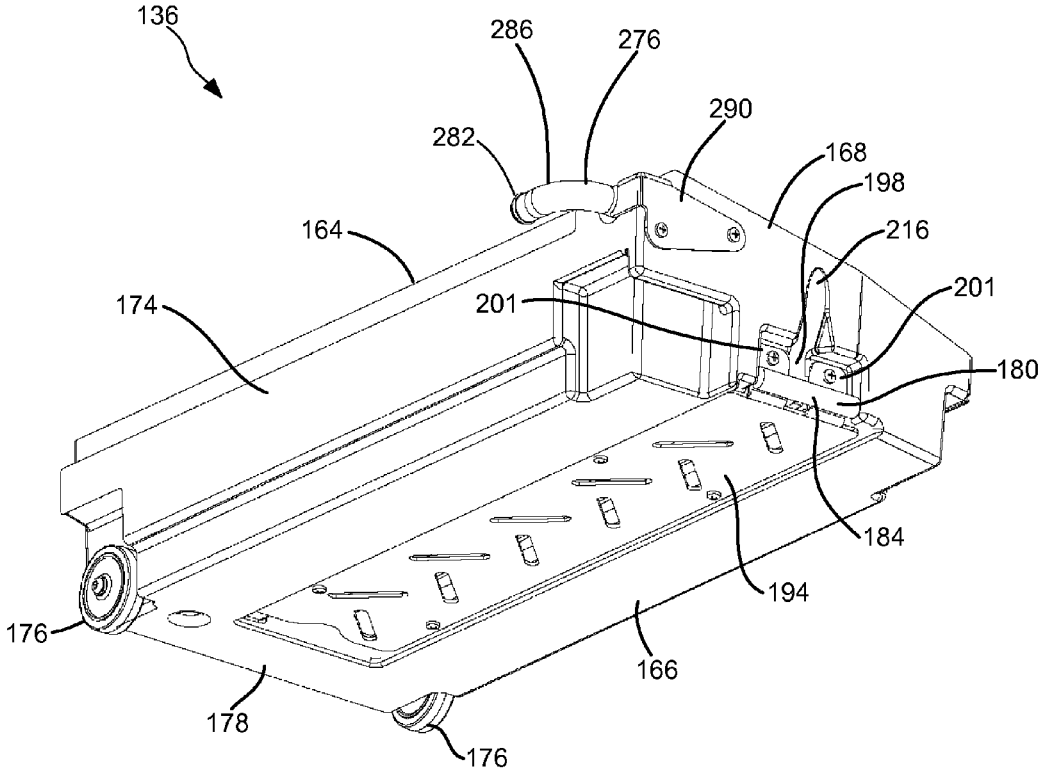

FIGS. 4 and 5 respectively are perspective top and bottom views of the debris tray 136 in accordance with embodiments of the invention. In one embodiment, the tray 136 includes a tray body 164 comprising a base 166, first and second opposing end walls 168 and 170, and first and second opposing side walls 172 and 174. The first and second opposing end walls 168 and 170 are attached to the base 166. The first and second side walls 172 and 174 are attached to the base 166 and the first and second end walls 168 and 170. An interior cavity 175 of the debris tray 136 defined by the base 166, the first and second end walls 168 and 170, and the first and second side walls 172 and 174, receives the waste thrown by the cleaning head 118.

One embodiment of the tray 136 includes two or more wheels 176 attached to the tray body 164. The wheels 176 facilitate easy movement of the tray 136 across a surface by supporting at least one end of the tray 136 above the surface. The wheels 176 can be mounted to the tray 136 in any conventional manner. In accordance with one embodiment of the invention, the wheels 176 are mounted to the side walls 172 and 174 of the tray 136 such that the bottom of each wheel extends slightly below the bottom surface of the tray 136. In accordance with one embodiment of the invention, the wheels 176 are mounted adjacent a rear end 178 of the tray 136. Other, more forward locations for the wheels can be used as well. Additional wheels can be mounted to the tray 136, if full wheel support of the tray 136 is desired.

Figure 6:
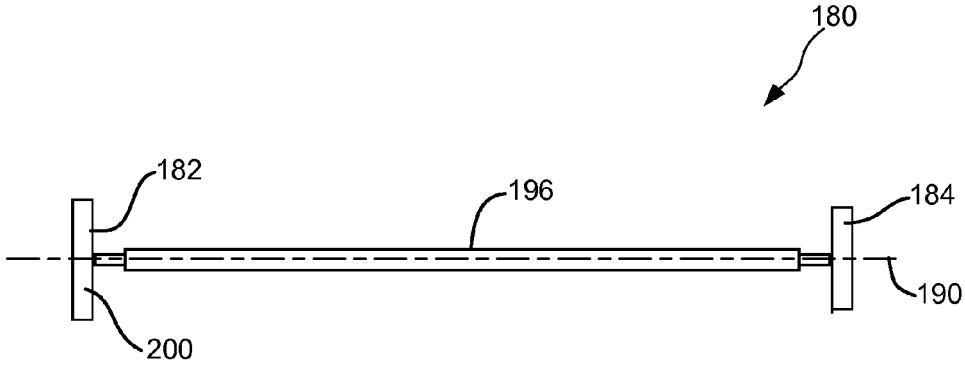
FIG. 6 is a top plan view of a handle for use with a debris tray in accordance with embodiments of the invention.

Another embodiment of the tray 136 includes a handle 180 that generally allows the operator to maneuver the tray from a standing position while minimizing direct contact with the tray 136 and, thus, the debris on and in the tray 136. FIG. 6 is a top plan view of the handle 180 in accordance with embodiments of the invention. A first end 182 of the handle 180 is coupled to the tray 136. Although depicted as having T-shaped ends 182 and 184, the handle 180 can take on many different shapes.

In accordance embodiments of the invention, the pivotal connection of the first end 182 of the handle 180 to the tray 136 allows the handle 180 to pivot in a vertical plane and/or a horizontal plane, as respectively indicted by arrows 186 and 188 (FIG. 4). In accordance with another embodiment of the invention, the handle 180 is allowed to rotate about a longitudinal axis 190 of the handle while coupled to the tray 136, as indicated by arrow 192. This pivotal and rotational movement of the handle 180 limits its ability to be used to apply a torque to the tray 136. As a result, the operator is encouraged to use the handle 180 primarily to maneuver the tray 136 by pulling it with the handle 180 in the desired direction.

In accordance with one embodiment of the invention, the handle 180 is mounted to the tray 136 at a central location at the first end wall 168. The central location is preferably aligned with the anticipated center of gravity of the tray 136 when it is loaded. This alignment of the handle 180 reduces undesired torque that could be applied to the tray 136 by the handle 180 during tray removal, installation or maneuvering operations.

In accordance with one embodiment of the invention, the handle 180 is detachable from the tray 136 when not in use, such as when the tray 136 is fully installed in the carriage 156 of the cleaner 100. The handle 180 can then be manually attached to the tray 136 when the operator needs to remove and dump the tray 136.

The handle 180 can also be placed in a stowed position, in which it is received within a handle receiving channel 194 of the tray 136, as shown in FIG. 5. When the handle is in the stowed position, the end 184 remains accessible to the operator at the end wall 168 of the tray 136. A support member 196 (e.g., a rod) of the handle 180, which connects the ends 182 and 184 together, is recessed within the channel 194 along with the first end 182, when the handle 180 is in the stowed position.

The handle 180 can be extended to an operating position (FIG. 4), in which the support member 196 is pulled through a slot 198 in the end wall 168. When in the operating position, the end 182 of the handle 180 that is received within the channel 194 is restricted from being extended further from the channel 194 using any suitable method. In accordance with one embodiment of the invention, the end 182 of the handle 180 is shaped such that when in at least one orientation relative to the slot 198, it is prevented from passing through the slot 198 to thereby define the extended limit of the handle 180. For example, the end 182 can have a cross bar 200 (FIG. 6) that is transverse to the member 196 that can be oriented such that it does not escape through the slot 198.

In accordance with another embodiment of the invention, the handle 180 is configured for removal from the channel 194 by positioning the end 182 in a predefined orientation relative to the slot 198. In general, the end 182 has a shape that is slightly smaller than the slot 198 when it is oriented in the proper manner. Thus, when the end 182 has a cross bar 200, the slot 198 can be an elongated slot, as shown in FIG. 5, such that when the cross bar 200 is aligned properly, the end 182 can be pulled through the slot 198. In another embodiment, one or more flanges 201 (FIG. 5) or other components are attached to the first end wall 168 and cover a portion of the slot 198 to prevent the removal of the end 182 of the handle from the channel 194. The flanges 201 can be L-shaped members that also attach to the base 166.

The slot 198 can also include a rubber skirt or other component that surrounds the member 196 of the handle 180 and prevents debris from entering the channel 194 through the slot 198.

Figure 7:
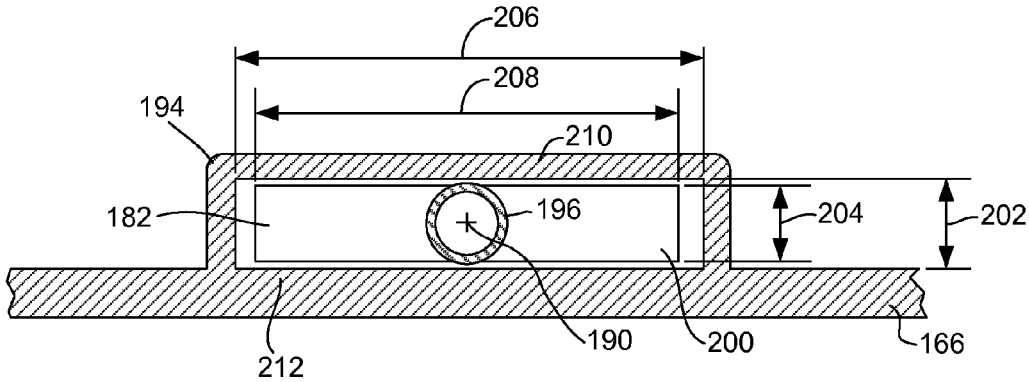
FIG. 7 is a cross-sectional view taken generally along line 7-7 of FIG. 4 when the handle is stowed in the handle receiving channel of the debris tray, in accordance with embodiments of the invention.

In accordance with another embodiment of the invention, the handle 180 is restricted from rotating about the longitudinal axis 190 of the handle 180. For example, the channel 194 can be sized to have an interior height 202 that is slightly larger than a thickness 204 of the cross bar 200 at the end 182, and an interior width 206 that is slightly larger than a length 208 of the cross bar 200, as shown in the simplified cross-sectional view of FIG. 7. As a result the cross bar 200 is restricted from rotating about the longitudinal axis 190 by the walls top and bottom walls 210 and 212 of the channel 194.

One advantage to having the centrally located channel 194 is that the walls of the channel 194 operate to increase the rigidity of the tray 136, which allows for a reduction in the thickness of the end walls 168 and 170 and the side walls 172 and 174 of the tray 136, as compared to debris trays of the prior art.

In one embodiment, the handle 180 can pivot to a vertical position in which a lower portion of the member 196 abuts the outside surface of the end wall 168 of the tray 136, as shown in FIG. 4. When in this upright position, the end 182 of the handle 180 that is within the channel 194 is pressed against the inside surface of the end wall 168 including, for example, the flanges 201, and the handle 180 is prevented from pivoting further in the vertical direction. This upright position of the handle 180 allows the operator to stop a forward motion of the tray (arrow 214 in FIG. 4) or push the tray in a backward direction that is opposite the forward direction, such as when loading the tray 136 back into the carriage 156.

In accordance with one embodiment of the invention, the tray 136 includes a handle member receiver 216 (FIG. 5) that is configured to conform to the lower portion of the member 196 of the handle 180, when the handle is in the vertical position (FIG. 4). This allows the operator to use the handle 180 to apply a torque to the tray 136 and rotate it about its longitudinal axis 218 (FIG. 4). The application of such a torque to the tray 136 is useful when dumping the contents of the tray 136 or performing other tray maneuvering operations.

A bottom 220 of the channel 194 can include one or more openings 222, shown in FIG. 5 to facilitate the removal of debris from within the channel 194 as the handle 180 is inserted and retracted from the channel 194.

Figure 8:
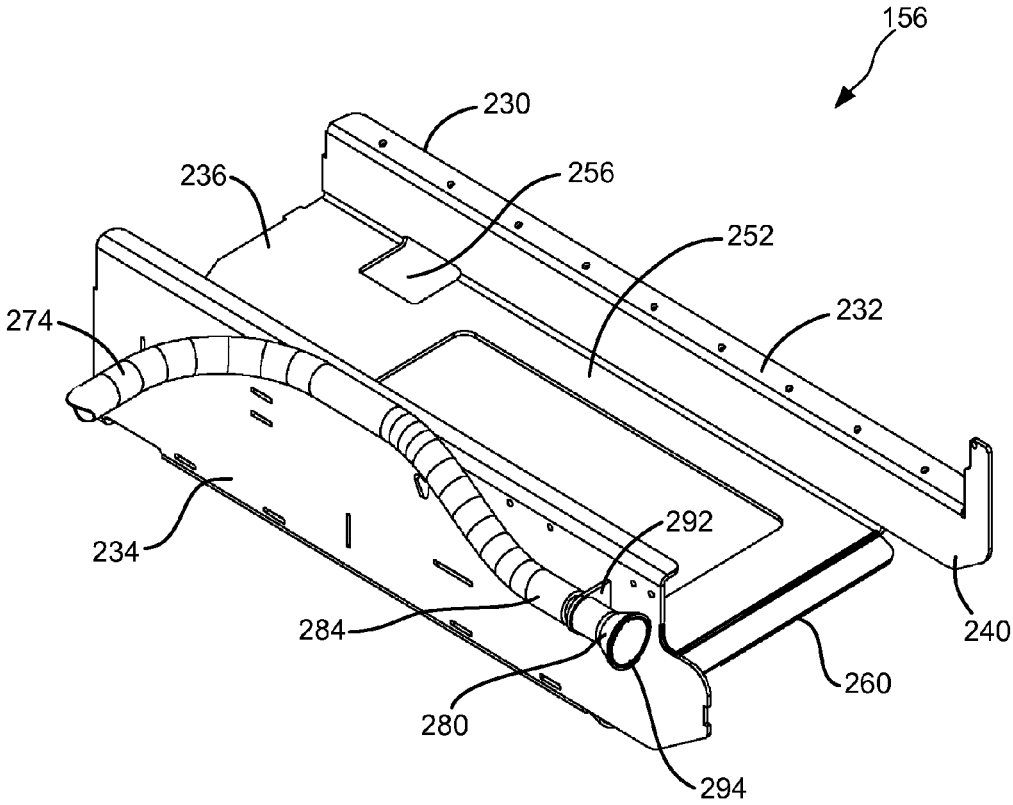
FIG. 8 is a perspective view of a carriage in accordance with embodiments of the invention.

FIG. 8 is a perspective view of the carriage 156 in accordance with embodiments of the invention. One embodiment of the carriage 156 comprises a frame 230 that attaches to the frame 112 of the cleaning machine 100, as shown in FIG. 3. In one embodiment, the frame 230 includes first and second side supports 232 and 234 and a base 236 extending between the side supports 232 and 234. The frame 230 attaches to the frame 112 of the cleaning machine 100 such that the base 236 is positioned proximate the floor 116.

Figure 11:
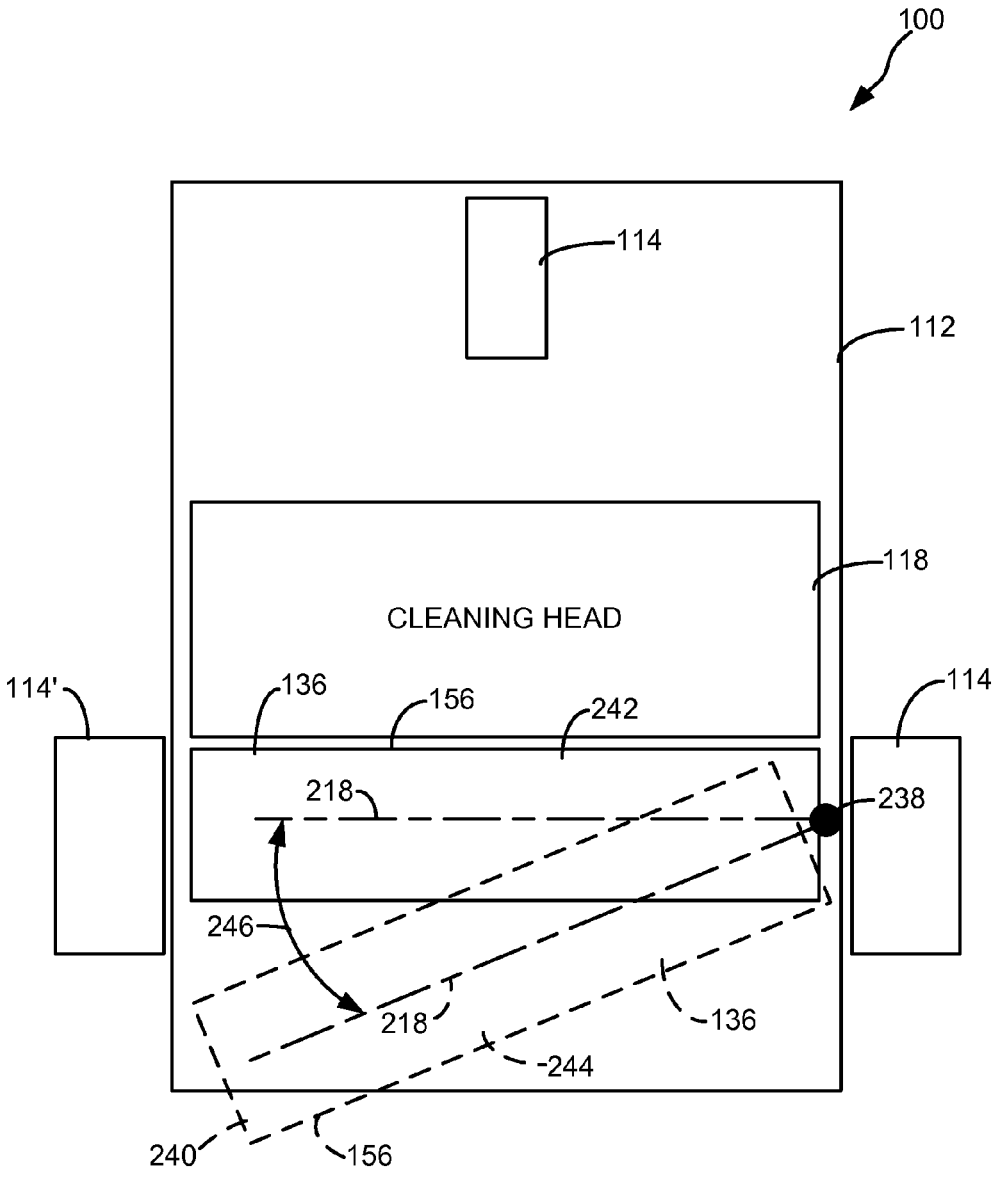
FIG. 11 is a simplified top plan view of a floor cleaning machine illustrating operating and release/receive positions of the carriage and tray of the debris collection system, in accordance with embodiments of the invention.

In one embodiment, the frame 230 of the carriage 156 is mounted to the frame 112 using conventional methods such that it can pivot about a vertical axis 238 relative to the frame 112 of the cleaning machine 100 to move a tray receiving end 240 of the carriage 156 out from behind the wheel 114', as shown in FIG. 3. The carriage 156 is configured to pivot about the vertical axis 238 between an operating position 242, shown in the simplified top plan view of FIG. 11, and a tray release/receive position 244, shown in FIGS. 3 and 11 (dashed box). The carriage is preferably locked in the operating position 242 during cleaning operations using a suitable latch or other method. When the carriage 156 is in the operating position 244, the tray 136 is in position to receive the debris thrown by the cleaning head 118. When the carriage is in the release/receive position 244, the tray 136 can be removed from the carriage 156 or installed into the carriage 156. In one embodiment, the carriage 156 is configured to pivot about the vertical axis 238 an angle 246 of approximately 30 degrees relative to the frame 112 of the mobile cleaner 100, as shown in FIG. 11.

Figure 9:
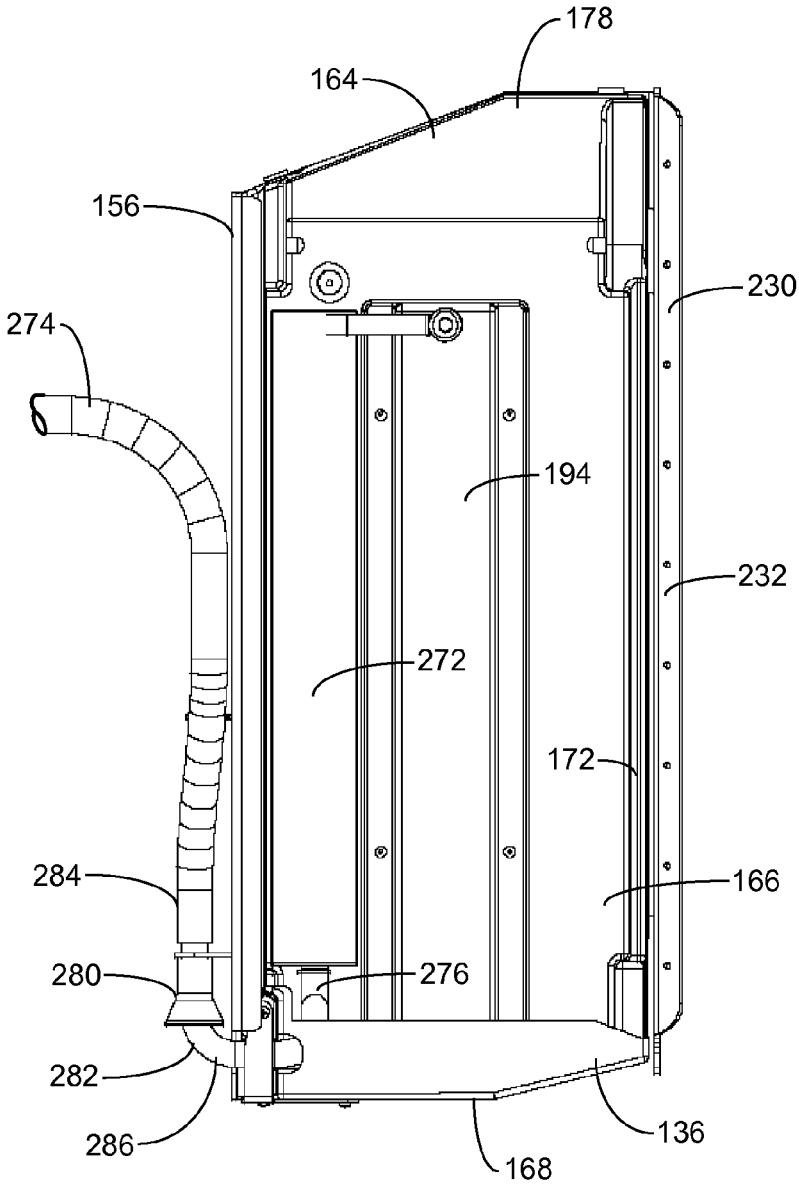
FIGS. 9 and 10 respectively are top and front plan views of a debris tray installed in a carriage, in accordance with embodiments of the invention.
Figure 10:
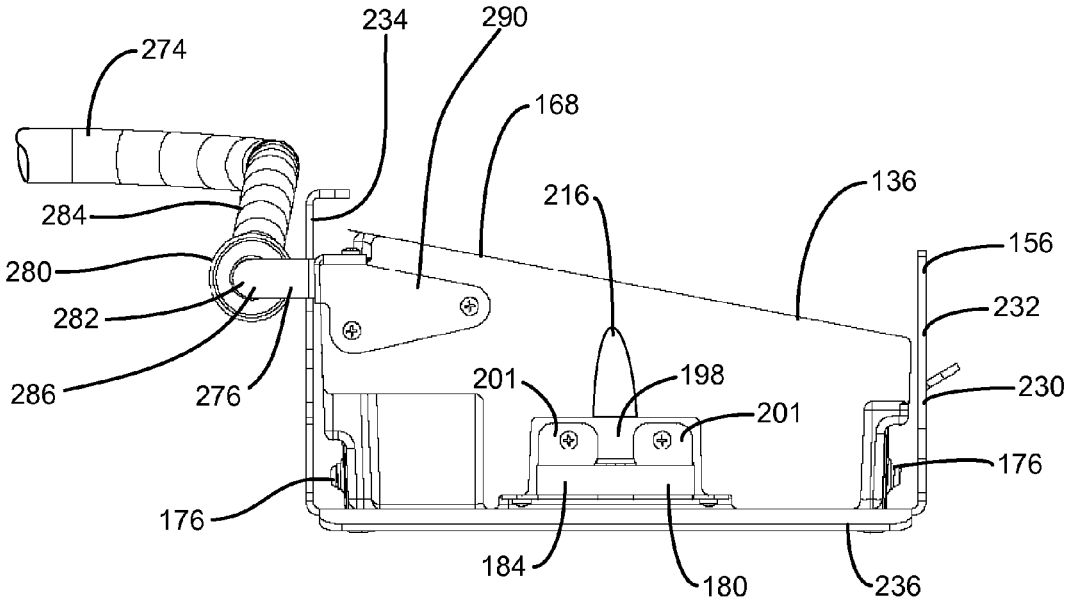

One embodiment of the base 236 of the carriage 156 includes openings 250 (FIG. 8) that are sized to receive the wheels 176 when the tray 136 is fully installed in the carriage 156 (FIG. 9). In accordance with one embodiment, the base 236 includes support rails 252 and 254 (FIGS. 3 and 8), on which the wheels 176 roll while supporting the tray 136 during installation of the tray 136 into the carriage 156. In one embodiment, the rails 252 and 254 respectively include openings 256 and 258, in which the wheels 176 become seated when the tray 136 is installed in the carriage 156. When the wheels 176 become seated in the openings 256 and 258, the weight of the tray 136 that was supported on the wheels 176 is transferred to the tray body 164, which rests on the base 236. Additionally, the seating of the wheels 176 in the openings 256 and 258 assists in properly positioning the tray 136 to receive debris from the cleaning head 118 and in securing the tray 136 within the carriage 156.

Another embodiment of the carriage 156 includes a ramped lip 260 at the receiving end 240 that receives the tray 136. The ramped lip 260 is angled downward from the base 236 toward the floor 116 to ease the transition for the tray 136 from the floor 116 to the carriage 156. The tray also includes an angled base 262 at the rear end 178, which engages the ramped lip 260 when pushed into the receiving end 240 of the carriage 156. These features simplify installation of the tray 136 into the carriage. These features allow the operator to install the tray 136 into the carriage 156 from a standing position using the handle 180 and without having to directly lift the tray 136. The rear end 178 of the tray 136 is simply rolled in the backward direction along the surface 116 using the handle, the angled base 262 then engages and slides over the ramped lip 260, which lifts the rear end 178 off the surface 116 and into the receiving end 240 of the carriage 156. Once the rear end 178 is received in the carriage 156, the remainder of the tray 136 can be rolled into the carriage on the wheels 176.

The vacuumized de-watering system 158 generally includes tubing 270 connecting the waste recovery tank 126 to a liquid extracting component 272 (e.g., perforated separator) that is configured to extract liquid from the interior cavity 175 of the tray 136, as shown in FIG. 2. In one embodiment, the liquid extracting component 272 is attached to the base 166 of the tray 136. The tubing 270 is divided between a main tubing section 274 that connects directly to the waste recovery tank 126 and a tray tubing section 276 that connects to the liquid extracting component 272. During cleaning operations, the main and tray tubing sections 274 and 276 are connected together to place the liquid extracting component 272 in vacuum communication with the vacuum 152 and to form a path through which liquid flows out of the tray 136 and to the waste recovery tank 126.

One embodiment of the invention relates to the automatic coupling and de-coupling of the main and tray tubing sections 274 and 276 of the vacuumized de-watering system 158 respectively during installation of the tray 136 into the carriage 156 and removal of the tray 136 from the carriage 156. This relieves the operator from having to locate and connect the open ends of the main and tray tubing sections 274 and 276, as is the case in prior art systems. Instead, the operator can focus on simply installing the tray 136 in the carriage 156 while the connection of the open end of the main tubing section 274 to the open end of the tray tubing section 276 occurs automatically. As a result, this embodiment of the invention not only relieves the operator of the burden of performing the tubing connection, but also avoids the problems that result when the operator forgets to perform the tubing coupling operation.

One embodiment of the de-watering system 158 includes two cooperating coupling components: a main coupling component 280 and a tray coupling component 282, as shown in FIGS. 5, 8, 9 and 10. The main coupling component 280 is attached to an end 284 of the main tubing section 274 and the tray coupling component 282 is attached to an end 286 of the tray tubing section 276. The main and tray coupling components 280 and 282 are configured to be automatically placed in predefined locations and, if necessary, predefined orientations during the tray installation and removal processes.

In accordance with one embodiment of the invention, the tray coupling component 282 is attached to the tray 136 in a manner that fixes its position relative to the tray 136. In one embodiment, the tray 136 includes a bracket 290 (FIGS. 5 and 10) that attaches to the end wall 268 of the tray 136 and holds the end 286 of the tray tubing section 276 and/or the tray coupling component 282 in a fixed position relative to the tray 136.

In one embodiment, the main coupling component 280 has a fixed position relative to the carriage 156 or otherwise is placed in a predetermined location during installation of the tray 136. In one embodiment, the carriage 156 includes a bracket 292 that supports the end 284 of the main tubing section 274 in the desired fixed position, as shown in FIG. 8.

The placement of the main and tray coupling components 280 and 282 in predetermined positions relative to the carriage 156 and the tray 136, respectively, allows the main and tray coupling components 280 and 282 to automatically engage (or couple) to each other when the tray 136 is installed in the carriage 156. The desired fixed positions of the main and tray coupling components 280 and 282 can be at other locations than those depicted and supported using other methods, without departing from the spirit of the present invention.

In accordance with another embodiment of the invention, the end 284 of the main tubing section 274 and the main coupling component 280 are positioned to receive the tray coupling component 282 when the tray 136 and the carriage 156 are pivoted from the release/receive position 244 to the operating position 242 (FIG. 11). In one embodiment of the invention, the main coupling component 280 is fixed relative to the frame 112 of the mobile body 110 and is positioned in a predetermined location relative to the carriage such that the main coupling component 280 automatically engages the tray coupling component 282 when the carriage 156 is pivoted from the release/receive position 244 to the to the operating position 242.

In another alternative embodiment, the main coupling component 280 is attached to a door of the mobile body 110 that is closed to complete the installation of the tray 136 in the operating position 242. When the tray 136 is positioned in the operating position 242 beneath the cleaner 100, the tray coupling component 282 is positioned to automatically engage or couple to the main coupling component 280 when the door is shut.

In accordance with another embodiment of the invention, at least one of the main and tray coupling components 280 and 282 is configured to be moved through mechanical means relative to the other coupling component during or after the tray 136 is installed in the carriage 156. For example, the main coupling component 280 can be moved relative to the carriage 156 to engage the tray coupling component 282, or the tray coupling component 282 can be moved relative to the tray 136 to engage the main coupling component 280. The movement of the coupling components can be motorized or manually driven by the operator through actuation of a lever arm or other means. The motorized movement of the coupling component can be automatically triggered by the full installation of the tray, the movement of the carriage to the operating position, the closing of a door, the pressing of a button by the operator, or other triggering event.

In accordance with one embodiment of the invention, the main and tray coupling components 280 and 282 are cooperating male and female members. Either the main coupling component 280 or the tray coupling component 282 is the male member and the other coupling component is the female member. In FIG. 2, the main coupling component 280 is the female member and the tray coupling component 282 is the male member. The male member is received by the female member to close the vacuum circuit between the main and tray tubing sections 274 and 276. Thus, a seal is created between the coupling components 280 and 282 to allow the vacuum 152 to remove liquid from the tray 136 through the main and tray tubing sections 274 and 276. The male and female coupling components are preferably rigid or semi-rigid and are formed of rubber, plastic, or other suitable material.

The female coupling component is preferably conical and includes a flared opening 294 (FIG. 8) to allow for the guided reception of the male coupling component 282. Additionally, the male and female coupling components preferably have a circular cross section, but other shapes can be used as well.

Other configurations for the main and tray coupling components 280 and 282 can also be used. For example, rather than being male and female cooperating components, the components can form a face seal in which abutting faces of the coupling components seal the junction to complete the vacuum circuit between the vacuum 152 and the liquid extracting component 272.

Below is a discussion of an exemplary operation of the debris collection system 102 in accordance with various embodiments of the invention. However, it is understood that embodiments of the invention include the individual embodiments of the debris collection system 102 described herein alone and in combination with other embodiments of the system.

In the event that the carriage 156 is positioned behind a wheel, such as wheel 114' in the exemplary cleaning machine 100 discussed above, the removal of the tray 136 from the cleaner 100 can begin by pivoting the carriage 156 from the operating position 242 to the tray release/receive position 244, shown in FIG. 11. Rather than pulling the tray 136 out by hand, the operator can, in accordance with above-described embodiments of the invention, grab the end 184 of the handle 180 and extend the handle 180 from the channel 194 or attach the end 182 of the handle 180 to the tray 136. The operator then, from a standing position, can pull the tray 136 in the forward direction 214 from the carriage 156 using the handle 180. The use of the handle 180 not only allows the operator to avoid contacting the waste contained in and on the tray 136, but the standing position that is made possible by the handle 180 allows the operator to more easily pull the tray 136 from the carriage 156 while reducing the likelihood of injury (e.g., muscle strain, etc.). The removal of the tray 136 from the carriage 156 automatically disconnects the main and tray tubing sections 274 and 276 of the de-watering system 158.

In one embodiment, once the tray 136 is removed from the carriage 156, at least a portion of the tray 136 is supported over the surface 116 on the wheels 176, which simplifies the maneuvering of the tray 136 to the desired dumping location as compared to trays of the prior art. With two wheels 176 at the rear end 178, the debris tray 136 is maneuvered in a similar manner as wheeled luggage. However, additional wheels can be added to the debris tray 136 to allow the tray 136 to be maneuvered like a cart with the entire base 166 being raised from the surface.

The handle 180 can be moved to the upright position (FIG. 4), in which the lower portion of the member 196 is received within the receiver 216. When in this position, handle 180 can be used to rotate the tray 136 about its longitudinal axis 218 to dump the contents. Thus, the operator can remain in a substantially standing position when dumping the tray 136 using the handle 180.

After the contents of the tray 136 have been dumped, the rear end 178 of the tray 136 is inserted into the receiving end 240 of the carriage 156 while the operator remains standing by pushing the tray with the handle 180 in the upright position. The ramped leading edged 260 of the base 236 of the carriage 156 allows the rear end 178 of tray 136 to roll into the receiving end 240 of the carriage 156. The wheels 176 fall into the openings 256 and 258 to fully seat the tray 136 in the carriage 156. The handle 180 can then be removed from the tray 136, or recessed into the handle receiving channel 194 of the tray 136. In the event that the carriage 156 is in the release/receive position 244, the carriage 156 is pivoted back to the operating position 242 and locked in position relative to the frame 112 of the cleaning machine 100.

In accordance with one embodiment, during the installation of the tray 136 into the carriage 156 or movement of the carriage 156 to the operating position 242, the main and tray coupling components 280 and 2282 automatically engage each other to seal the junction between the main and tray tubing sections 274 and 276 of the de-watering system 158. The floor cleaning machine 100 is then ready to perform cleaning operations on the surface 116.

Although the present invention has been described with reference to preferred embodiments, workers skilled in the art will recognize that changes may be made in form and detail without departing from the spirit and scope of the invention.

What is claimed is:

1. A debris collection system for a floor cleaning machine having a mobile body including a frame and wheels connected to the frame comprising:

a motorized cleaning head attached to a frame of the floor cleaning machine;

a carriage attached to the frame;

a debris tray removably receivable within the carriage and positioned to receive debris thrown from the motorized cleaning head; and a de-watering system comprising:

a liquid extracting component attached to the debris tray and configured to extract liquid from within the debris tray;

a tray tubing section having a first end coupled to the liquid extracting component and a second end mounted in fixed relation to the debris tray;

a waste recovery tank supported on the frame;

a main tubing section having a first end connected to the waste recovery tank and a second end positioned to automatically couple to the second end of the tray tubing section upon installation of the debris tray; and a vacuum in vacuum communication with the main tubing section.

2. The system of claim 1, wherein the debris tray further comprises:

a tray body including, a base, first and second opposing end walls attached to the base, and first and second opposing side walls attached to the base and to the first and second end walls, wherein an interior cavity of the debris tray is defined by the base, the first and second end walls and the first and second side walls; and wheels attached to the tray body.

3. The system of claim 2, further comprising a handle having a first end coupled to the debris tray, a second end displaced from the first end along a longitudinal axis of the handle and an elongate member connecting the first and second ends.

4. The system of claim 3, wherein the first end wall includes a handle member receiver having a shape that conforms to a portion of the elongate member, wherein the handle is configured to pivot about the first end to a raised position in which a portion of the elongate member of the handle is received within the handle member receiver.

5. The system of claim 3, further comprising a handle receiving channel coupled to the base of the debris tray, wherein the handle includes a stowed position, in which the first end of the handle and the elongate member is received within the receiving channel, and an operating position, in which the support member is substantially extended from the handle receiving channel.

6. The system of claim 1, wherein:

the second end of the tray tubing section includes a first coupling component; and the second end of the main tubing section includes a second coupling component;

the first and second coupling components cooperate to couple the tray tubing section to the main tubing section during installation of the debris tray into the carriage.

7. The system of claim 6, wherein:

the first coupling component includes an opening that faces a direction in which the debris tray is inserted into the carriage; and the second coupling component includes an opening that faces a direction from which the debris tray is received by the carriage.

8. The system of claim 7, further comprising:

a tray tubing support attached to the debris tray and to the second end of the tray tubing section, the tray tubing support fixing the position of the first coupling component relative to the debris tray; and a main tubing support attached to the carriage and to the second end of the main tubing section, the main tubing support fixing the position of the second coupling component relative to the carriage.

9. A floor cleaning machine comprising:

a mobile body comprising a frame supported on wheels for travel over a surface;

a motorized cleaning head attached to the frame;

a carriage attached to the frame;

a debris tray removably receivable within the carriage and positioned to receive debris thrown from the motorized cleaning head; and a de-watering system comprising:

a liquid extracting component attached to the debris tray and configured to extract liquid from within the debris tray;

a tray tubing section having a first end coupled to the liquid extracting component and a second end mounted in fixed relation to the debris tray;

a waste recovery tank supported on the frame;

a main tubing section having a first end connected to the waste recovery tank and a second end positioned to automatically couple to the second end of the tray tubing section upon installation of the debris tray; and a vacuum in vacuum communication with the main tubing section.

10. The machine of claim 9, wherein the debris tray further comprises:

a tray body including, a base, first and second opposing end walls attached to the base, and first and second opposing side walls attached to the base and to the first and second end walls, wherein an interior cavity of the debris tray is defined by the base, the first and second end walls and the first and second side walls; and wheels attached to the tray body.

11. The system of claim 10, further comprising a handle having a first end coupled to the debris tray, a second end displaced from the first end along a longitudinal axis of the handle and an elongate member connecting the first and second ends.

12. The system of claim 11, wherein the first end wall includes a handle member receiver having a shape that conforms to a portion of the elongate member, wherein the handle is configured to pivot about the first end to a raised position in which a portion of the elongate member of the handle is received within the handle member receiver.

13. The system of claim 11, further comprising a handle receiving channel coupled to the base of the debris tray, wherein the handle includes a stowed position, in which the first end of the handle and the elongate member is received within the receiving channel, and an operating position, in which the support member is substantially extended from the handle receiving channel.

14. The system of claim 9, wherein:

the second end of the tray tubing section includes a first coupling component; and the second end of the main tubing section includes a second coupling component;

the first and second coupling components cooperate to automatically couple the tray tubing section to the main tubing section during installation of the debris tray into the carriage.

15. The system of claim 14, wherein:

the first coupling component includes an opening that faces a direction in which the debris tray is inserted into the carriage; and the second coupling component includes an opening that faces a direction from which the debris tray is received by the carriage.

16. The system of claim 15, further comprising:

a tray tubing support attached to the debris tray and to the second end of the tray tubing section, the tubing support fixing the position of the first coupling component relative to the debris tray; and a main tubing support attached to the carriage and to the second end of the main tubing section, the tubing support fixing the position of the second coupling component relative to the carriage.

17. In a floor cleaning machine having a mobile body comprising a frame supported on wheels for travel over a surface, a motorized cleaning head attached to the mobile body, a debris collection system comprising a carriage attached to a frame of the floor cleaning machine, a debris tray removably receivable within the carriage and positioned to receive debris thrown by the motorized cleaning head, and a de-watering system including a liquid extracting component attached to the debris tray and configured to extract liquid from within the debris tray, a tray tubing section having a first end coupled to the liquid extracting component, a waste recovery tank supported on the frame, a main tubing section having a first end connected to the waste recovery tank, and a vacuum in vacuum communication with the main tubing section, a method of coupling the tray tubing section to the main tubing section comprising steps of:

supporting a second end of the tray tubing section in a predefined position relative to the tray;

supporting a second end of the main tubing section to automatically couple to the second end of the tray tubing section during installation of the debris tray into the carriage; and installing the debris tray into the carriage including coupling the second end of the tray tubing section to the second end of the main tubing section.

18. The method of claim 17, wherein:

the debris tray further comprises wheels; and the installing step comprises:

inserting an end of the debris tray into a receiving end of the carriage;

rolling the debris tray into the carriage on the wheels, which engage rails of the carriage; and seating the wheels in openings in the rails.

19. The method of claim 17, wherein the step of supporting the second end of the main tubing section comprises fixing the position of the second end of the main tubing section relative to the carriage.

20. The method of claim 17, wherein the installing step further comprises pivoting the carriage relative to the frame of the floor cleaning machine.

* * * * *

UNITED STATES PATENT AND TRADEMARK OFFICE

CERTIFICATE OF CORRECTION

PATENT NO. : 7,805,802 B2
APPLICATION NO. : 11/584677
DATED : October 5, 2010
INVENTOR(S) : Kevin L. Shinler et al.

It is certified that error appears in the above-identified patent and that said Letters Patent is hereby corrected as shown below:

Item (57) Abstract, please delete "A debris collection system for a floor cleaning machine includes a motorized cleaning head attached to a frame of the floor cleaning machine, a carriage attached to the frame, a debris tray, and a de-watering system. The debris tray is removably receivable within the carriage and is positioned to receive debris thrown from the motorized cleaning head. The de-watering system includes a liquid extracting component, a tray tubing section, a main tubing section, a waste recovery tank supported on the frame and a vacuum in vacuum communication with the main tubing section. The liquid extracting component is attached to the debris tray and is configured to extract liquid from within the debris tray. The tray tubing section has a first end that is coupled to the liquid extracting component and a second end that is mounted in fixed relation to the debris tray. The a main tubing section has a first end that is connected to the waste collection tank and a second end that is positioned to automatically couple to the second end of the tray tubing section upon installation of the debris tray" and insert --A debris collection system for a floor cleaning machine includes a motorized cleaning head attached to a frame of the floor cleaning machine, a carriage attached to the frame, a debris tray, and a de-watering system. The debris tray is removably receivable within the carriage and is positioned to receive debris thrown from the motorized cleaning head. The de-watering system includes a liquid extracting component, a tray tubing section, a main tubing section, a waste recovery tank supported on the frame and a vacuum in vacuum communication with the main tubing section. The liquid extracting component is attached to the debris tray and is configured to extract liquid from within the debris tray. The tray tubing section has a first end that is coupled to the liquid extracting component and a second end that is mounted in fixed relation to the debris tray. The main tubing section has a first end that is connected to the waste collection tank and a second end that is positioned to automatically couple to the second end of the tray tubing section upon installation of the debris tray--.

Signed and Sealed this
Twelfth Day of June, 2012

David J. Kappos

David J. Kappos
*Director of the United States Patent and Trademark Office*